US005977920A

United States Patent [19]

Hung

[11] Patent Number: 5,977,920

[45] Date of Patent: Nov. 2, 1999

[54] DOUBLE ANTENNA ESPECIALLY FOR VEHICLES

[75] Inventor: Frédéric Ngo Bui Hung, Franconville, France

[73] Assignee: Thomson-CSF, Paris, France

[21] Appl. No.: 08/994,565

[22] Filed: Dec. 19, 1997

[30] Foreign Application Priority Data

Dec. 27, 1996 [FR] France ..... 96 16113
Oct. 20, 1997 [FR] France ..... 97 13099

[51] Int. Cl.[6] ..... H01Q 1/32

[52] U.S. Cl. ..... 343/715; 343/856; 343/729

[58] Field of Search ..... 343/715, 729, 343/745, 749, 856, 875

[56] References Cited

U.S. PATENT DOCUMENTS

| | | | |
|---|---|---|---|
| 5,216,434 | 6/1993 | Fukumura | 343/876 |
| 5,311,201 | 5/1994 | Lillie et al. | 343/791 |
| 5,317,327 | 5/1994 | Piole | 343/725 |
| 5,751,253 | 5/1998 | Wells | 343/749 |

FOREIGN PATENT DOCUMENTS

| | | |
|---|---|---|
| 0 456 337 A2 | 11/1991 | European Pat. Off. . |
| 38 26 777 A1 | 2/1990 | Germany . |
| 40 07 824 A1 | 9/1991 | Germany . |
| 43 21 233 A1 | 5/1994 | Germany . |
| WO 87/00351 | 1/1987 | WIPO . |

*Primary Examiner*—Don Wong
*Assistant Examiner*—Shih-Chao Chen
*Attorney, Agent, or Firm*—Oblon, Spivak, McClelland, Maier & Neustadt, P.C.

[57] ABSTRACT

The invention relates chiefly to double antennas for metric and decimetric waves, designed for vehicles. The antenna comprises a single-pole antenna for low frequencies surmounted by a dipole type antenna for high frequencies. The supply cable of the dipole antenna has an external conductor used to form the single-pole antenna above the ground plane. Beneath the ground plane, this external conductor is wound in turns to constitute the secondary winding of a transformer for the supply of the single-pole antenna. Application especially to ground vehicles.

12 Claims, 4 Drawing Sheets

DOUBLE ANTENNA ESPECIALLY FOR VEHICLES

BACKGROUND OF THE INVENTION

The present invention relates to double antennas for fixed stations or moving vehicles and especially, but not exclusively, to antennas designed for wheeled vehicles whose working frequencies are located in the metric and decimetric wavebands, also known as the VHF and UHF wavebands.

The term "double antenna" is understood to mean an antenna formed by several radiating elements arranged so as to work in transmission and/or reception in a first frequency band with a first arrangement of radiating elements and in a second frequency band with a second arrangement. Some of these antennas may be used simultaneously in both frequency bands.

There are known ways of making a double antenna with a single-pole type of radiating element for the low frequencies. For the high frequencies, this single-pole type of radiating element is surmounted by a dipole type of radiating element supplied through the single-pole type of radiating element. Known antennas of this type work in a frequency band that is insufficient for certain applications.

SUMMARY OF THE INVENTION

The invention is aimed at preventing or at least reducing this drawback.

The study of known double antennas with single-pole antennas surmounted by a dipole, like the one described in the patent DE 3826777, shows that there is a ground return of the high frequency channel which is not direct but goes through a filter located in the low frequency channel. This means that, for efficient operation, the frequency bands corresponding to the two channels must be at a great distance from each other and that the antenna is therefore not a wideband antenna.

To achieve the aim sought, it is proposed, in particular, in the antenna according to the invention to supply the single-pole antenna by means of a secondary transformer that is series-connected with the radiating element of the single-pole antenna.

According to the invention, there is thus proposed a double antenna, especially for vehicles, comprising:

a ground plane drilled with a hole having, on one side of the ground plane, the space external to the vehicle and, on the other side, a protected space;

a coaxial cable that goes through the hole, this cable having a characteristic impedance, an external conductor and an internal conductor, a first end in the space external to the vehicle and a second end in the protected space, the cable forming turns between the hole and its second end;

a link between the external conductor of the cable and the ground plane at the level of the second end;

a dipole type radiating element which is connected, in order to be supplied, to the second end of the cable;

a transformer having a primary winding and a secondary winding that comprises the external conductor of the turns;

an impedance with a value equal to the characteristic impedance of the cable, the impedance having a first end coupled to the ground plane and a second end;

a supply cable;

and switch-over means designed either to couple the supply cable to the second end of the coaxial cable or to couple the supply cable to the primary winding of the transformer and, simultaneously, to connect the second end of the impedance to the second end of the coaxial cable.

According to the invention, there is furthermore proposed a double antenna, especially for vehicles, comprising:

a ground plane drilled with a hole having, on one side of the ground plane, the space external to the vehicle and, on the other side, a protected space;

a coaxial cable that goes through the hole, this cable having a characteristic impedance, an external conductor and an internal conductor, a first end in the space external to the vehicle and a second end in the protected space, the cable forming turns between the hole and its second end;

a link between the external conductor of the cable and the ground plane at the level of the second end;

a dipole type radiating element which is connected, in order to be supplied, to the second end of the cable;

a transformer having a primary winding and a secondary winding that comprises the external conductor of the turns;

an impedance with a value equal to the characteristic impedance of the cable, the impedance having a first end coupled to the ground plane and a second end;

a first and second supply cable;

and connecting means to permit a coupling between the first cable and the primary winding of the transformer, between the second cable and the second end of the coaxial cable and between the second end of the impedance and the internal conductor of the second end of the coaxial cable.

BRIEF DESCRIPTION OF THE DRAWINGS

The present invention will be understood more clearly from the following description and from the appended figures, of which.

In the different figures, the corresponding elements are designated by the same references.

MORE DETAILED DESCRIPTION

The description that follows considers transmitter antennas but of course, owing to the reversibility of electromagnetic waves, these antennas could also work in reception mode.

Figure 1:
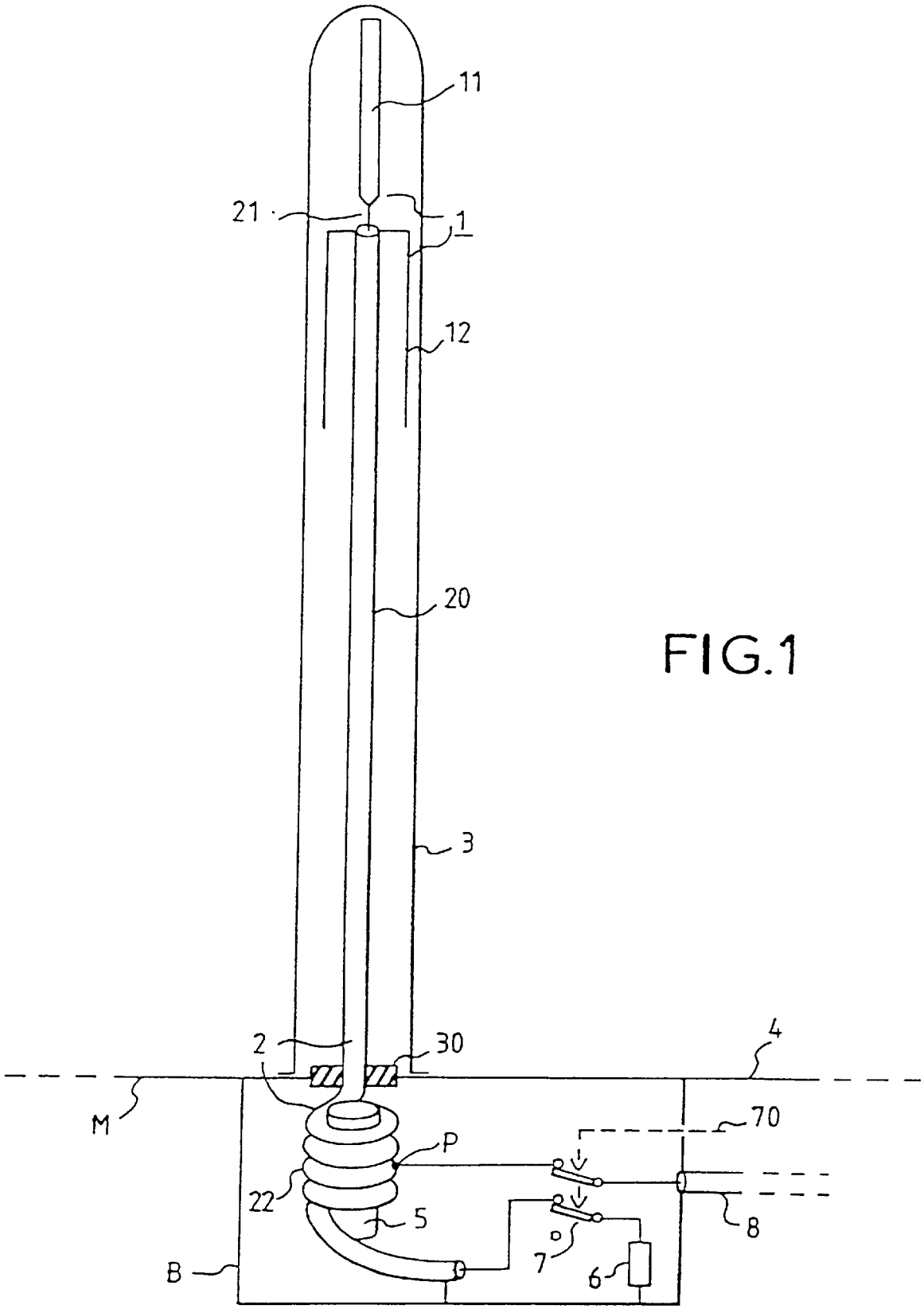
FIG. 1 is a simplified view of a single-pole antenna surmounted by a dipole.

FIG. 1 shows a switched-element antenna. For a clearer understanding of the drawing, the proportions between the dimensions have not maintained in this figure.

The antenna that has been used as an example for the description that follows is an antenna designed to work in the 30–400 MHz band.

The antenna is shown as mounted on a metal roof M of a vehicle, this metal roof M being seen in a cross-section. It comprises, under the roof M, a metal case B seen in a sectional view. The contents of this case shall be described further below. On the roof M, the antenna has radiating elements protected by a radome 3. The radiating elements comprise a skirt dipole 1 and a conductive cylindrical section 20 constituted by the external conductor of the upper part of a flexible coaxial cable 2. This coaxial cable goes through the roof M and the lower part is contained in the case B. The crossing of the roof by the cable 2 is done through a circular hole with an insulating ring 30 between the cable and the edges of the hole.

The radome, which is made of dielectric material transparent to electromagnetic waves, maintains the radiating elements in the vertical position and fixes them solidly to the case B.

In this assembly, the roof M and the case B constitute a counterweight for the antenna, namely a set of conductors that provides the antenna, which is insulated from the earth, with a ground reference.

The skirt dipole 1 has a conductive vertical bar 11 as its upper part and a skirt 12 formed by a conductive tube having its base drilled with a hole as its lower part. This dipole is supplied at its center by the coaxial cable 2. For this purpose, the internal conductor 21 of the coaxial cable 2 is connected at its upper end to the lower end of the vertical bar 11 and the metal braid that constitutes the external conductor of the cable is connected to the edges of the hole drilled at the base of the skirt 12. In FIG. 1, the skirt 12 has been shown only by its lines traced in the plane of the drawing so as to provide a view of the way in which the coaxial cable 2 is connected at its upper end to the dipole 1.

The cable 2, after having crossed the roof M to penetrate the case B, is wound about a ferromagnetic core 5 where it forms a coil 22 Then, towards its lower end, this cable 2 has its external conductor connected to the case B and its internal conductor connected to the fourth port of a five-port, two-position switch 7.

The switch 7 is a mechanical switch whose electrical control is shown by a discontinuous arrowhead line 70. The first port of the switch 7 is connected to the internal conductor of a coaxial supply cable 8 which, coming from the exterior of the case B, reaches a hole drilled in this case. The metal braid of the external conductor of the cable 8 is soldered to the walls of the hole. The second port of the switch 7 is connected through a resistor 6 to the port B. The third port is connected at a point P of the coil 22 to the external conductor of the cable 2 and the fifth port is not connected. In its high position, as shown in FIG. 1, the switch 7 connects its first port to its third port and its second port to its fourth port while, in its low position, it connects its first port to its fourth port and its second port to its fifth port.

Thus, with the switch 7 in the low position, the supply cable 8 and the cable 2 are connected end to end within the case B and everything happens as if the supply of the dipole 1 is obtained by a simple coaxial cable that has the same starting point as the cable 8 and, like the cable 20, ends at the dipole 1.

With the switch 7 in the high position, the external conductors of the cables 2 and 8 are still connected to each other by means of the case B which serves as a ground reference. By contrast, the internal conductor of the cable 8 is connected to a point P of the external conductor of the coil 22. The external conductor of the coil 22 with the core 5 constitutes an autotransformer with firstly a common point connected to the ground, secondly a primary winding located between the ground and the point P and thirdly a secondary winding located between the ground and the section 20 referred to here above when the radiating elements of the antenna were being designated. Thus, in the high position of the switch 7, the signal given by the cable 8 is applied to the external conductor of the cable 2.

The value of the resistor 6 is chosen deliberately to be equal to the characteristic impedance of the transmission line constituted by the coaxial cable 2. When the switch 7 connects this resistor to the lower end of the cable 2, the principles governing electrical lines indicate that everything happens on the electrical plane as if the resistor were connected between the upper ends of the internal and external conductors of the cable 2.

Figure 2:
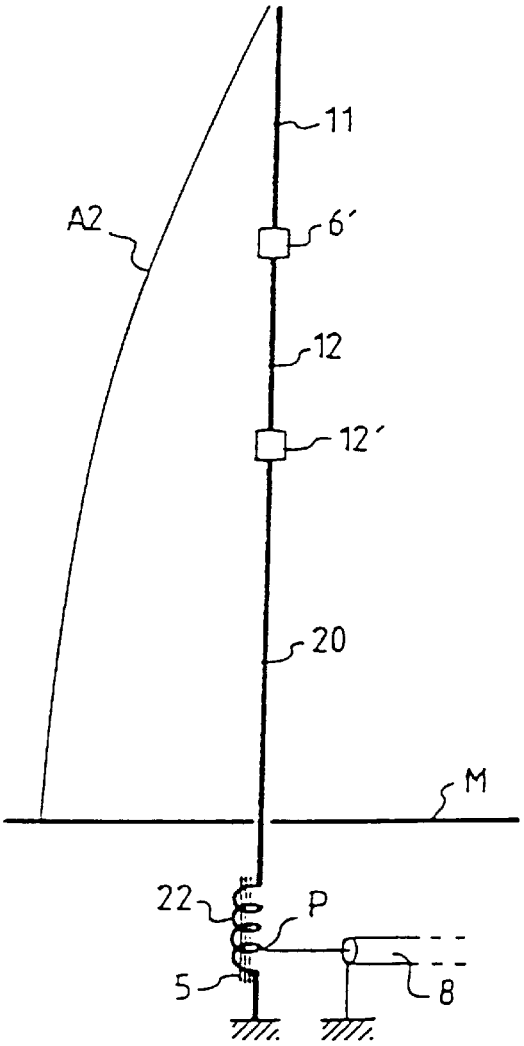
FIGS. 2 and 3 are electrical diagrams of the antenna according to FIG. 1, in each of its two modes of operation.

Should the switch 7 be in the high position, which corresponds to the use of the antenna in the 30–108 MHz frequencies corresponding to the low band of its operating frequencies, the radioelectrical diagram of the antenna may be drawn as shown in FIG. 2. In this Figure, the influence of the skirt 12 of the dipole 1 has been represented by an impedance 12', placed at the level of the lower end of the skirt. At the frequencies of use considered, this impedance is self-inductive with a negligible value. The influence of the resistor 6 referred to here above is represented by a resistor 6' equal to the resistor 6 and placed between the elements 11 and 12.

The antenna in its configuration according to FIG. 2 is a single-pole antenna charged by an inductance 12' that has only a negligible role and by a resistor 6' that enables the attenuation of the overvoltage of this single-pole antenna and therefore the widening of its passband. This single-pole antenna, at the level of its base, has a ground plane M constituted by the roof of the vehicle and is supplied at its base by means of the autotransformer 22-5 to whose primary winding the supply cable 8 is connected.

Figure 3:
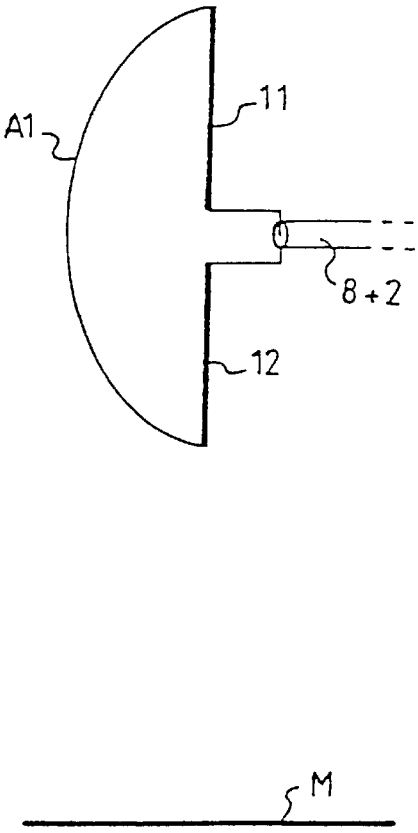

Should the switch 7 according to FIG. 1 be in a low position, corresponding to the use of the antenna in the high band (108–400 MHz) of its operating frequencies, the radioelectrical pattern of the antenna may be drawn as indicated in FIG. 3.

The antenna in its configuration according to FIG. 3 is a dipole 11–12 supplied at its center by the cable 8, 2 placed end to end.

Curves A2 and A1 represent the distribution of the current flowing respectively in the single-pole antenna 20, 12, 11 according to FIG. 2 and in a dipole 11–12 according to FIG. 3.

The antenna that has been used as an example for the above description has:

- a total length of each of the elements 11, 12 equal to 5/8ths of the wavelength at 400 MHz, i.e. substantially 45 cm,
- a total height above the roof M equal to 5/8ths of the wavelength at 108 MHz, i.e. substantially 170 cm,
- a radome diameter of 20 mm such that the antenna retains a certain degree of discretion,
- a characteristic working impedance of 93 ohms which requires the interposition of an impedance transformer between the switch 7 and the cable 8 to make the antenna compatible with stations having a standardized characteristic impedance value of 50 ohms. In order to retain only the elements needed for the understanding of the invention, this impedance transformer has not been drawn in the figures.

Figure 4:
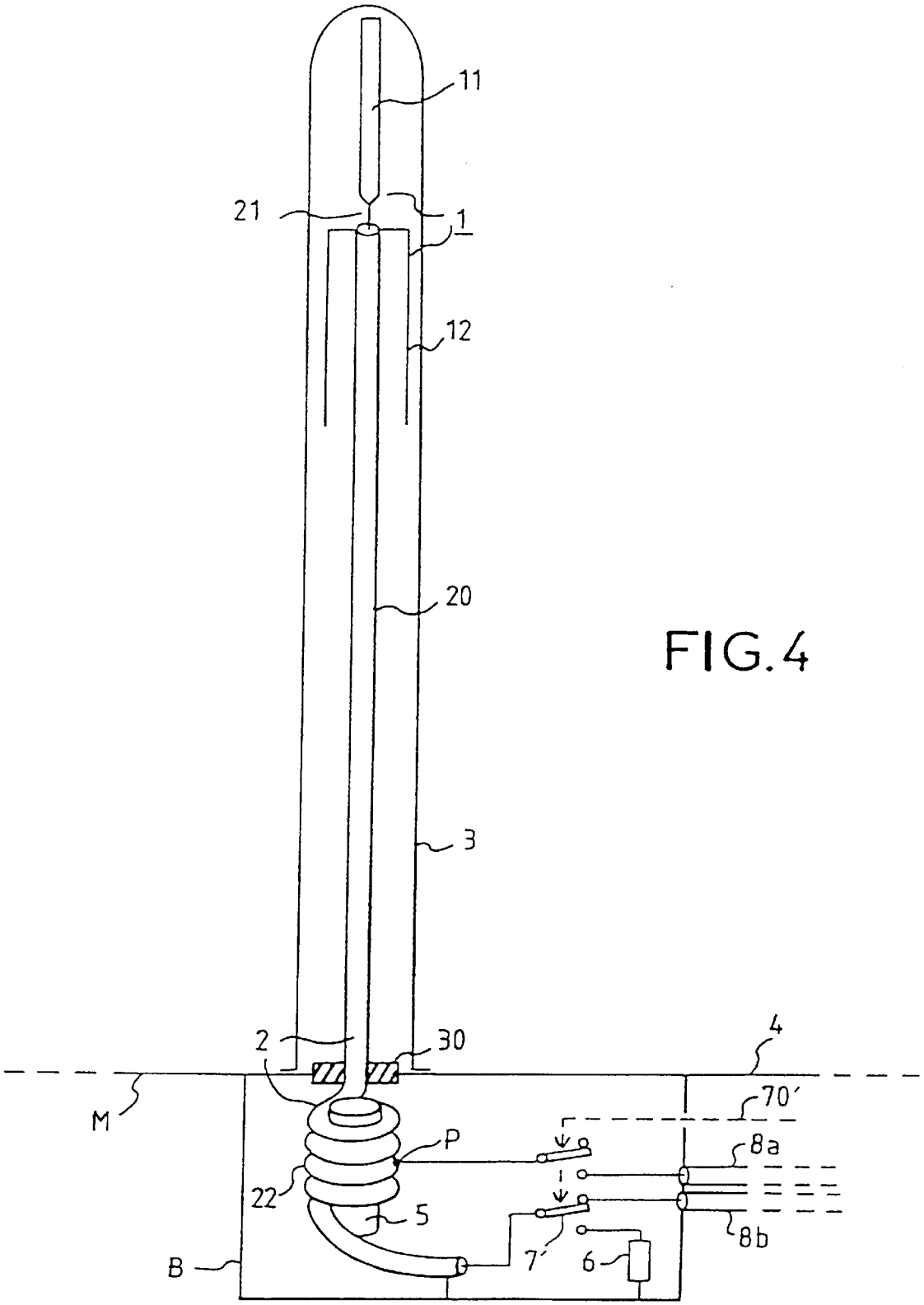
FIGS. 4 and 5 are drawings of two variants of the antenna according to the invention.

FIG. 4 is a drawing of a first variant of the antenna according to FIG. 1. It is a two-port antenna to which it is possible to connect respectively two transmitters and/or receivers but only one of these two transmitters and/or receivers can work at a time.

The antenna according to FIG. 3 can be distinguished from the antenna according to FIG. 1 only by a switch 7' whose wiring is different from that of the switch 7 and by the presence of two coaxial supply cables **8*a*, 8*b*** instead of only one.

The switch 7' is a mechanical switch with two positions and five ports in service. Its electrical control is represented by a discontinuous arrowhead line 70'. The cables 8*a*, 8*b*, like the cable 8 according to FIG. 1, come from the exterior of the case B, respectively leading into two holes drilled in this case and have the metal braid of their external conductor soldered to the wall of the case. Their internal conductors are extended respectively up to the second and fourth ports of the switch 7'.

In the high position, as indicated in FIG. 4, the switch 7' leaves the cable 8*a* without any connection on the antenna but, through its third and fourth ports, provides for a connection of the internal conductor of the cable 8*b* with the lower end of the internal conductor of the cable 2, namely with a high frequency dipole antenna.

In the low position, the switch leaves the cable 8*b* without any connection with the antenna but, through its first and second ports, provides for a connection of the cable 8*a* with the point P, namely with the primary winding of the supply autotransformer of the low-frequency single-pole antenna. Furthermore, in the low position, the switch 7', through its third and fifth ports, connects the resistor 6 to the lower end of the internal conductor of the cable 2.

Figure 5:
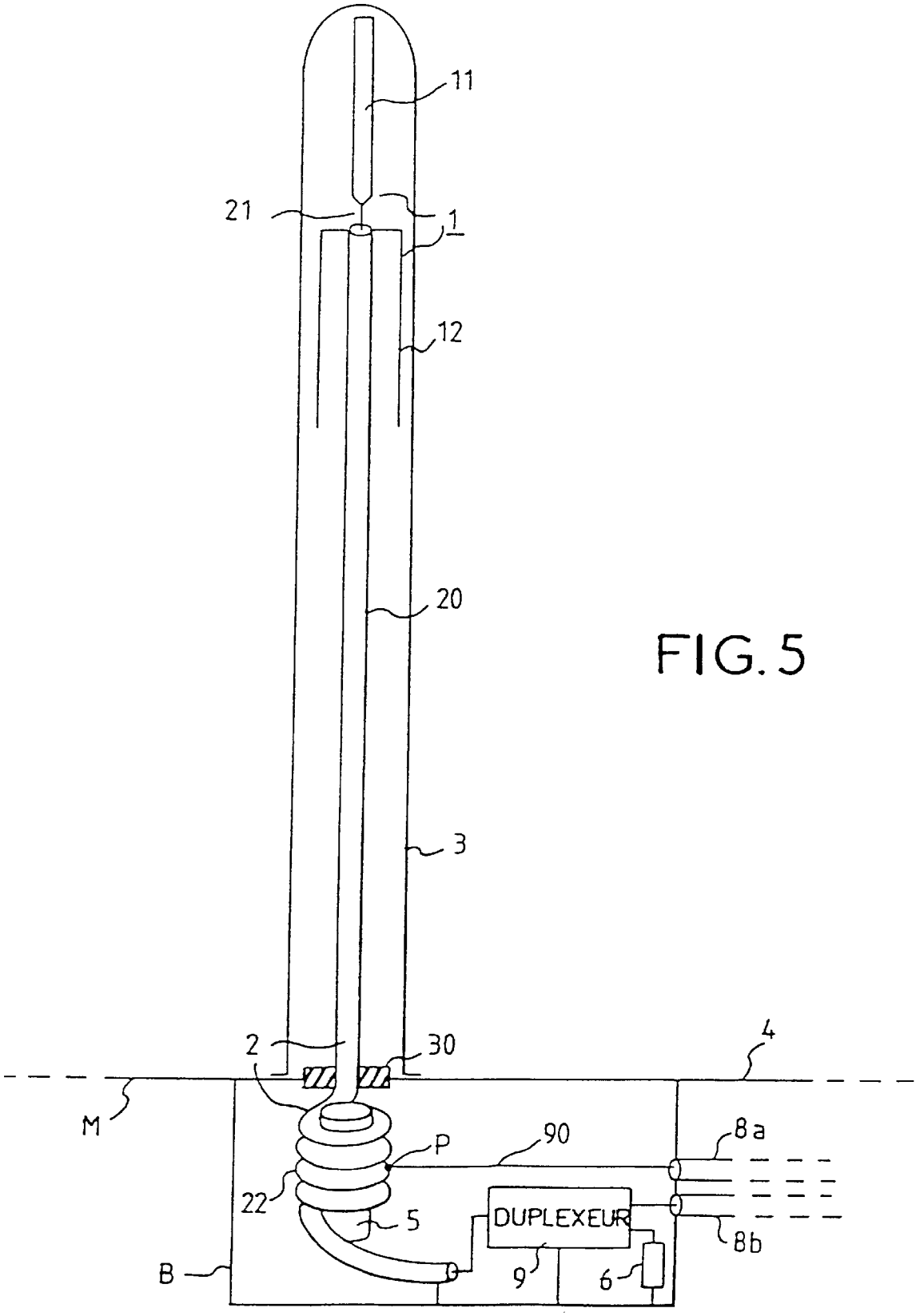

FIG. 5 is a drawing of a second variant of the antenna according to FIG. 1. This is a two-port antenna to which it is possible to connect respectively two transmitters and/or receivers with, this time, the possibility of simultaneous operation of both transmitters and/or receivers.

The antenna according to FIG. 5 can be distinguished from the antenna according to FIG. 1 only by the absence of the switch which is replaced by a duplexer 9, the presence of two supply coaxial cables 8*a*, 8*b* and a specific wiring at the level of the cables and duplexers. As compared with the antenna according to FIG. 4 where the switching was a space-division switching by means of the switch 7', this is a frequency-division switching using the duplexer 9.

The cables 8*a*, 8*b* come from the exterior of the case B, respectively leading to two holes drilled in this case B and have the metal braid of their external conductor soldered to the wall of the case while their internal conductors are extended respectively towards the point P by a direct link 90 and towards the first input of a duplexer 9 whose other input is connected to the resistor 6. The output of the duplexer 9 is connected to the lower end of the internal conductor of the cable 2 and the ground of the duplexer is connected to the case B.

Through the duplexer 9, everything happens as if it is the resistor 6 that is connected for the low frequencies, namely for the single-pole antenna while, for the high frequencies, namely for the operating frequencies of the dipole antenna, everything happens as if it is the cable 8*b* that is connected. It must be noted that the working of the duplexer requires that the high frequency band and the low frequency band should be separated from each other by the duplex frequency spacing proper to the duplexer used.

The invention is not limited to the examples described and shown in the drawings. Thus:

the coaxial cable 2 may be a relatively rigid cable so that it is not necessary to use any radome or at least any rigid radome, provided that the assembly 1–2 according to FIG. 1 is made sufficiently rigid, instead of the autotransformer 22-5, it is possible to use a transformer whose secondary winding is constituted for example by the coil 22. The primary winding could be constituted by another coil wound about the core 5 above the coil 22 with a first end connected to the ground, for example in contact with the lower end of the external conductor of the cable 2. The second end of the primary winding of the transformer would be connected to the conductor which, in FIGS. 1, 4 and 5, ended at the point P and now no longer ends at this point P. Besides, this point P now no longer has any role to play, the vertical bar 11 may have a diameter that varies in length and, for example, may have the same diameter as the skirt. It may also be replaced by a wire conductor charged by capacitors, namely by an alignment formed by conductive sections separated by capacitors with, for example, three conductive sections and two capacitors, the skirt dipole 1 may be replaced by any other dipole type antenna that can be used at the working frequencies considered, two filters may be introduced to improve the matching of the antenna with the station for which it is intended: a lowpass filter for operation in the low frequency band and a highpass filter for operation in the high frequency band, the working frequencies, especially as far as the antennas for fixed stations are concerned, may be in the decametric (i.e. HF) wave band, the switches 7 and 7' may be electronic switches.

What is claimed is:

1. A combined monopole-dipole antenna comprising:

a ground plane with two sides, drilled with a hole having, on one side of the ground plane, an external space and, on the other side, a protected space;

a coaxial cable that goes through the hole, this cable having a characteristic impedance, and external conductor and an internal conductor, a first end in the external space and a second end in the protected space, the cable forming turns between the hole and its second end these turns forming a part of the cable and having therefore an external and an internal conductor;

a link between a point of the external conductor near the second end of the cable and the ground plane;

a dipole type radiating element which is connected to the first end of the cable;

a transformer having a primary winding and a secondary winding wherein the external conductor of the turns of the cable form at least the secondary winding;

an impedance element with a value equal to the characteristic impedance of the cable, the impedance having a first end coupled to the ground plane and a second end;

a supply cable;

and switch-over means designed either to couple the supply cable to the second end of the coaxial cable or to couple the supply cable to the primary winding of the transformer and, simultaneously, to connect the second end of the impedance element to the internal conductor of the coaxial cable at the second end of said coaxial cable.

2. A combined monopole-dipole antenna comprising:

a ground plane with two sides drilled with a hole having, on one side of the ground plane, an external space and, on the other side, a protected space;

a coaxial cable that goes through the hole, this cable having a characteristic impedance, an external conductor and an internal conductor, a first end in the external space and a second end in the protected space, the cable forming turns between the hole and its second end these turns forming a part of the cable and having therefore an external and an internal conductor;

a link between a point of the external conductor near the second end of the cable and the ground plane;

a dipole type radiating element which is connected to the second end of the cable;

a transformer having a primary winding and a secondary winding wherein the external conductor of the turns of the cable form at least the secondary winding;

an impedance element with a value equal to the characteristic impedance of the cable, the impedance having a first end coupled to the ground plane and a second end;

a first and second supply cable;

and connecting means to permit a coupling between the first cable and the primary winding of the transformer, between the second cable and the second end of the coaxial cable and between the second end of the impedance element and the internal conductor of the coaxial cable at the second end of said coaxial cable.

3. An antenna according to claim 2, wherein the connecting means comprise a space-division switching device for the performance, under the control of a control signal given by the switching device, of either the coupling between the first cable and the primary winding of the transformer and the coupling between the impedance element and the second end of the coaxial cable or the coupling between the second cable and the second end of the coaxial cable.

4. An antenna according to claim 2, wherein the connection means comprise a direct link between the first cable and the primary winding of the transformer and a frequency-division switching device in order to carry out, in a first frequency band, the coupling between the impedance element and the second end of the coaxial cable and, in a second frequency band, the coupling between the second cable and the second end of the coaxial cable.

5. An antenna according to claim 1 comprising a rigid radome fixedly joined to the ground plane, this radome surrounding the dipole type radiating element as well as the part of the coaxial cable located in the external space, and wherein the dipole type radiating element is a flexible cable.

6. An antenna according to claim 1, wherein the dipole type radiating element is a skirt antenna.

7. An antenna according to claim 1, wherein the transformer is an autotransformer whose primary winding is constituted by a part of the external conductor of the turns.

8. An antenna according to claim 1, wherein the transformer has a ferromagnetic core around which the turns are wound.

9. An antenna according to claim 2 comprising a rigid radome fixedly joined to the ground plane, this radome surrounding the dipole type radiating element as well as the part of the coaxial cable located in the external space, and wherein the dipole type radiating element is a flexible cable.

10. An antenna according to claim 2, wherein the dipole type radiating element is a skirt antenna.

11. An antenna according to claim 2, wherein the transformer is an autotransformer whose primary winding is constituted by a part of the external conductor of the turns.

12. An antenna according to claim 2, wherein the transformer has a ferromagnetic core around which the turns are wound.

* * * * *